US007326133B1

(12) United States Patent
Choi

(10) Patent No.: US 7,326,133 B1
(45) Date of Patent: Feb. 5, 2008

(54) RACKET ASSEMBLY THAT WARNS OF A FATIGUED STRING CONDITION

(76) Inventor: In Young Choi, 20 Traverse Dr., Plymouth Meeting, PA (US) 19462

( * ) Notice: Subject to any disclaimer, the term of this patent is extended or adjusted under 35 U.S.C. 154(b) by 77 days.

(21) Appl. No.: 11/244,851

(22) Filed: Oct. 7, 2005

(51) Int. Cl.
*A63B 49/00* (2006.01)

(52) U.S. Cl. ..... 473/553

(58) Field of Classification Search ..... 473/524, 473/553; 73/570
See application file for complete search history.

(56) References Cited

U.S. PATENT DOCUMENTS

| | | | | |
|---|---|---|---|---|
| 4,183,200 | A * | 1/1980 | Bajaj | 57/234 |
| 4,822,042 | A | 4/1989 | Landsman | |
| 4,911,441 | A * | 3/1990 | Brunner | 473/461 |
| 5,007,294 | A * | 4/1991 | Matjasic | 73/862.41 |
| 5,327,714 | A * | 7/1994 | Stevens et al. | 57/230 |
| 5,646,911 | A * | 7/1997 | Davis | 368/10 |
| 6,134,965 | A * | 10/2000 | Somville | 73/570 |
| 6,270,434 | B1 * | 8/2001 | Shaw | 473/553 |
| D458,171 | S | 6/2002 | Lin | |
| 6,409,616 | B1 | 6/2002 | Lin | |
| 6,527,655 | B2 * | 3/2003 | Sims et al. | 473/524 |
| 2002/0068652 | A1 * | 6/2002 | Sims et al. | 473/553 |
| 2004/0077438 | A1 * | 4/2004 | Choi | 473/553 |

* cited by examiner

*Primary Examiner*—Raleigh W. Chiu
(74) *Attorney, Agent, or Firm*—LaMork & Associates

(57) ABSTRACT

A racket assembly having a racket head that is supported by a handle. A string is strung across the racket head forming a string face. The string used in the string face is statistically likely to fail after the string face has been impacted a precalculated number of times. At least one sensor is provided for sensing when the racket head experiences a change in acceleration that exceeds a predetermined threshold level. A logic circuit creates a count corresponding to the number of times the sensor detects a change in acceleration in excess of the predetermined threshold level. An indicator is provided that creates an indication when the count approaches the precalculated number. In this manner, a person is warned when the string of the racket is statistically likely to fail.

17 Claims, 4 Drawing Sheets

RACKET ASSEMBLY THAT WARNS OF A FATIGUED STRING CONDITION

BACKGROUND OF THE INVENTION

1. Field of the Invention

The present invention relates to rackets that are used in sports activities such as tennis, racquetball, squash, badminton and the like. More particularly, the present invention relates to rackets and electronic devices that attach to rackets and gather data from the strings of the racket.

2. Description of the Prior Art

There are many sports that are played with a racket. One of the most popular of these sports is tennis. In the game of tennis, the racket includes an oblong head section supported by a handle. A string is strung back and forth through the head section of the racket, thereby producing a mesh structure. The mesh structure creates the surface that is used in the game to contact the ball.

In the prior art, the head sections of rackets have been typically manufactured with periodic apertures. To create the mesh structure across the head of the racket, a single unbroken string is woven through the various apertures. As the string is being woven through the apertures in the head section of the racket, the string is kept at a preset tension that is desired by the player.

Since the stringing of a racket with a single string is a complicated process, most players have their rackets professionally strung. A professional stringer typically has a stringing machine that assists in weaving the string through the various apertures in the head section of the racket at the appropriate tension. One problem associated with having a racket professionally strung is that it is expensive and inconvenient. If the racket string breaks during a game, the player cannot fix the racket string and continue with the game. Rather, a player must either change rackets or stop playing.

Recreational tennis players often own inexpensive rackets. Commonly, a recreational player can buy an inexpensive new pre-strung racket for less money than it would cost to have their old racket professionally pre-strung. However, players with expensive rackets have little choice but to restring their rackets if the string breaks.

When the racket string of a conventional racket breaks, the string becomes loose and leaves the weave pattern. Since only one string is used, the broken string eventually unwinds to a point where the racket is no longer functional.

The primary reason that a string in a racket breaks is due to fatigue. When a ball strikes a racket, the string is stretched. Once the ball rebounds from the racket, the string again contracts. The stretching and contracting cycles of the string cause fatigue in the material of the string. Depending upon the tension of the string, the material of the string and the diameter of the string, the string may break between a few hundred strikes and a few thousand strikes.

In the prior art, there are several electronic devices that attach to rackets. Many of these electronic devices are used to count calories or to keep score of the game. Consider, for example, the score keeping device in U.S. Pat. No, D458, 171 to Lin, entitled Racket Counter. Consider also the calorie counter in U.S. Pat. No. 6,409,616 to Lin, entitled Calorie Counter Racket.

In U.S. Pat. No. 4,822,042 to Landsman, entitled Electronic Athletic Equipment, a system is shown where sensors are attached to various strings in a racket. The sensors are used to determine if a player is striking a ball with the proper portion of the racket. Although this system does collect data from the strings relating to ball impact, the system requires a specialized racket head having sensors placed around the periphery of the string field. Such systems do not track impacts for the purpose of determining string fatigue and the statistical probability that the string will break.

A need exists in the art for a system that can be added to standard racket designs that counts how many times the racket has been used to impact a ball and provides some indication of when a racket's strings are approaching failure. In this manner, a racket can be serviced prior to the failure of the string and the string will not fail during play. This need is met by the present invention as described and claimed below.

SUMMARY OF THE INVENTION

The present invention is a racket assembly such as that used in the game of tennis, racquetball, squash, badminton and the like. A racket assembly has a racket head that is supported by a handle. A string is strung across the racket head forming a string face. The string used in the string face is statistically likely to fail after the string face has been impacted a precalculated number of times.

At least one sensor is provided for sensing when the racket head experiences a change in acceleration that exceeds a predetermined threshold level. A logic circuit creates a count corresponding to the number of times the sensor(s) detect a change in acceleration in excess of the predetermined threshold level. Finally, an indicator is provided that creates an indication when the count approaches the precalculated number. In this manner, a person is warned when the string of the racket is statistically likely to fail.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention assembly can be used in association with any strung racket, such as a racquetball racket, a squash racket, a badminton racket or the like, the present invention assembly is particularly well suited for use as a tennis racket. Accordingly, the exemplary embodiment of the present invention assembly will be described in an application as a tennis racket. However, it will be understood that any other type of racket can be substituted for the tennis racket described.

Figure 1:
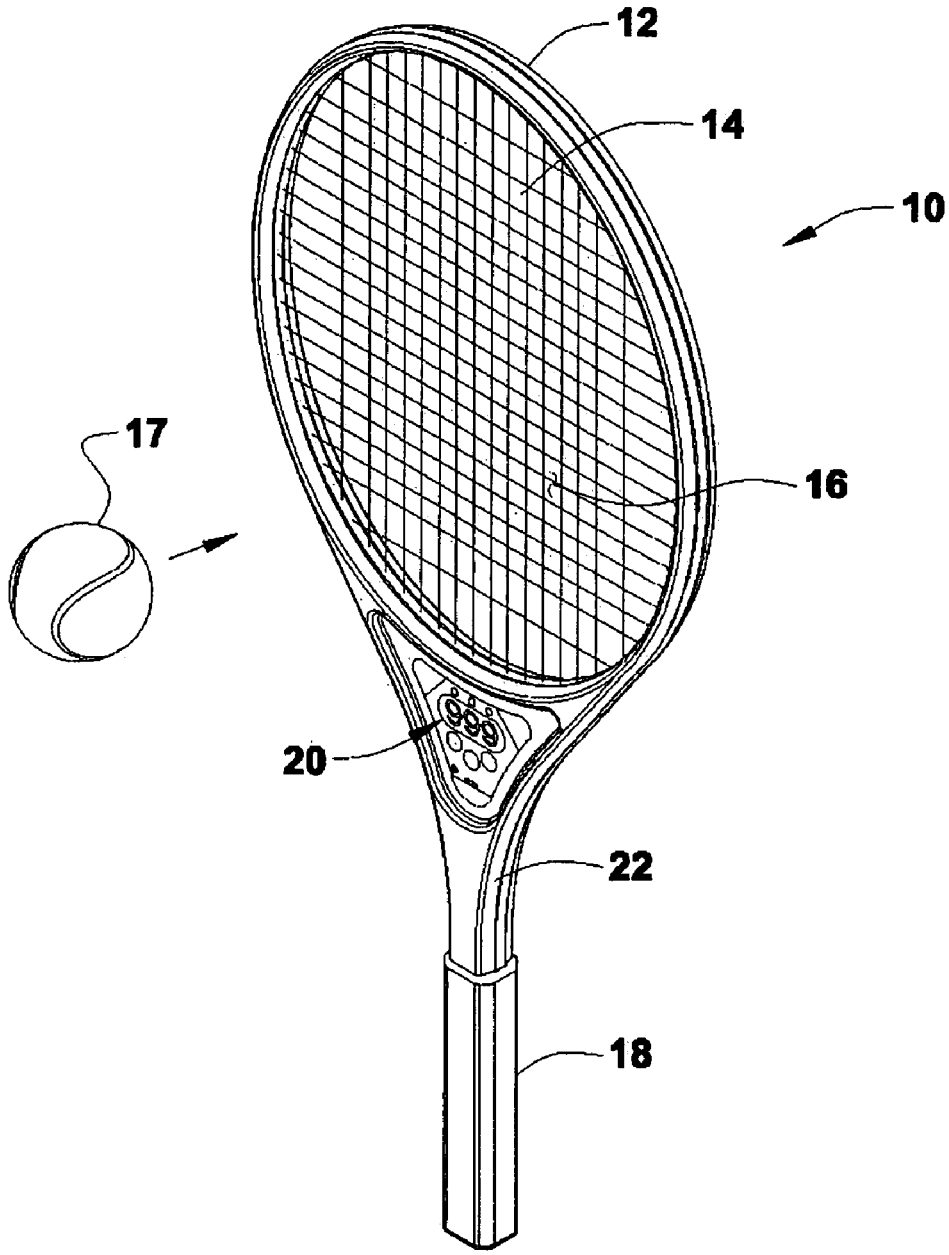
FIG. 1 is a front view of one preferred embodiment of a racket in accordance with the present invention.

Referring to FIG. 1, a tennis racket assembly 10 is shown in accordance with the present invention. The tennis racket assembly 10 includes an elliptical head section 12 that supports a string 14 that is interwoven into vertical and horizontal rows. The interweaving of the string 14 in the head section 12 creates the string face 16 of the tennis racket assembly 10. It is the string face 16 of the tennis racket assembly 10 that is used to strike a tennis ball 17.

The head section 12 is attached to a handle 18 by a tapered neck 22, such as is standard in the industry.

An electronics module 20 is set into the tennis racket assembly 10 within the area of the tapered neck 22. As such, the electronics module 20 is supported on the tennis racket assembly 10 above the point where a player grips the handle 18. The electronics module 20, therefore, always experiences a swinging movement when the tennis racket assembly 10 is swung.

Figure 2:
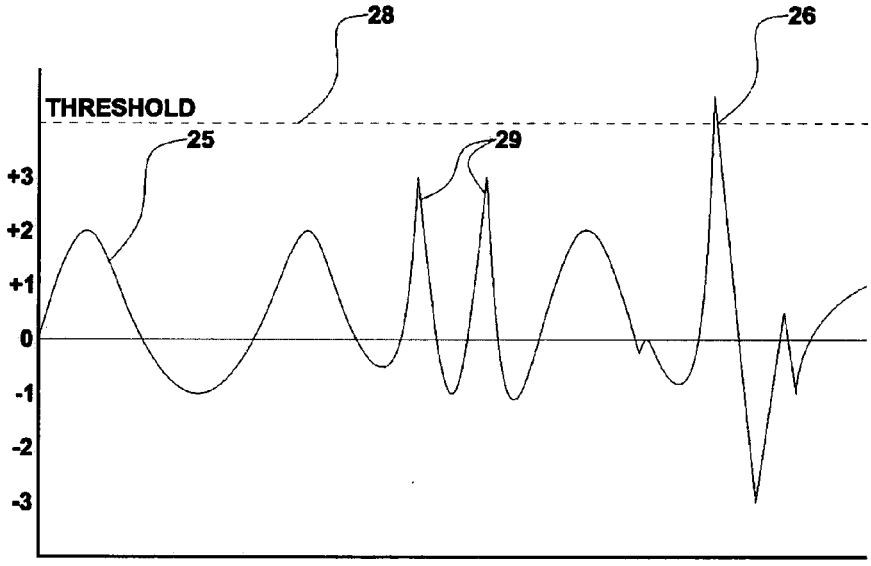
FIG. 2 is a graph that plots acceleration forces for a series of impact events.

When the tennis racket assembly 10 is swung, the head 12 of the racket assembly 10 experiences both positive and negative G-forces. Referring briefly to FIG. 2, it can be seen that the G-forces experienced by the head section of the tennis racket assembly fluctuate as the tennis racket assembly is swung in the air or changed from hand to hand by a player. These mild fluctuations are shown by the low amplitude sinusoidal pattern 25. However, when the tennis racket assembly is swung hard and actually impacts a tennis ball, an impact spike 26 is created that shows a dramatic change in acceleration. A threshold level 28 is set. The threshold level 28 is not reached during normal manipulations of the tennis racket assembly. Rather, the threshold level 28 is set high enough so that only the impact spike 26 of a solid ball impact during play will surpass the threshold level 28.

Smaller spikes 29 in acceleration may occur if a player is using the tennis racket assembly to bounce a ball. However, these smaller spikes 29 do not reach the threshold level 28. Accordingly, only a solid impact during play will create an acceleration event, such as the impact spike 26, that surpasses the set threshold level 28.

Returning to FIG. 1, it will be understood that as the tennis racket assembly 10 experiences changes in acceleration, the string face 16 deforms. Deformation of the string face 16 that is caused by the tennis racket assembly 10 being swung through the air is negligible. The only deformations that count toward the fatigue failure of the string face 16 are accelerations that surpass the threshold level 28 shown in FIG. 2. This type of acceleration only occurs when a player strikes the tennis ball 17 firmly with the racket assembly 10 during play. As a tennis ball 17 contacts the tennis racket assembly 10, the string face 16 deforms. The deformation cycles the string 14 thereby causing that string 14 to come closer to failing from fatigue.

The electronics module 20 counts only acceleration events that surpass the threshold value 28 shown in FIG. 2. Thus, the electronics module 20 counts how many times the tennis racket assembly 10 has firmly struck a ball, and thus how many times the string face 16 has been significantly deformed.

The number of deformation cycles until failure are known by racket designers. The number of cycles until failure is programmed into the electronics module 20. The electronics module 20 compares the number of acceleration events detected to the predicted cycles until failure. As the number of detected acceleration events approaches the predicted number of cycles until failure, a warning indication is provided.

Figure 3:
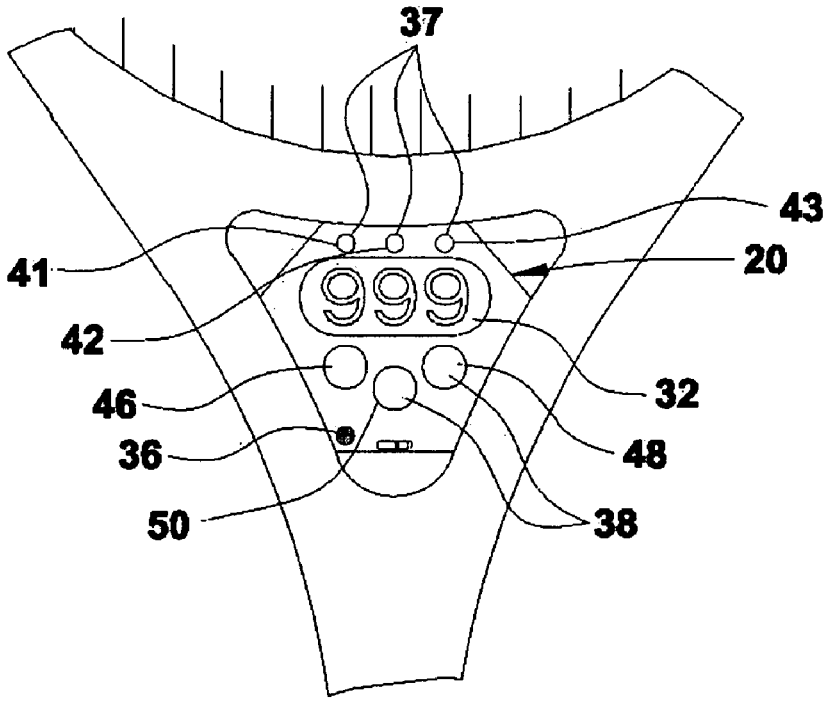
FIG. 3 is an enlarged view of the electronic module shown in FIG. 1.
Figure 4:
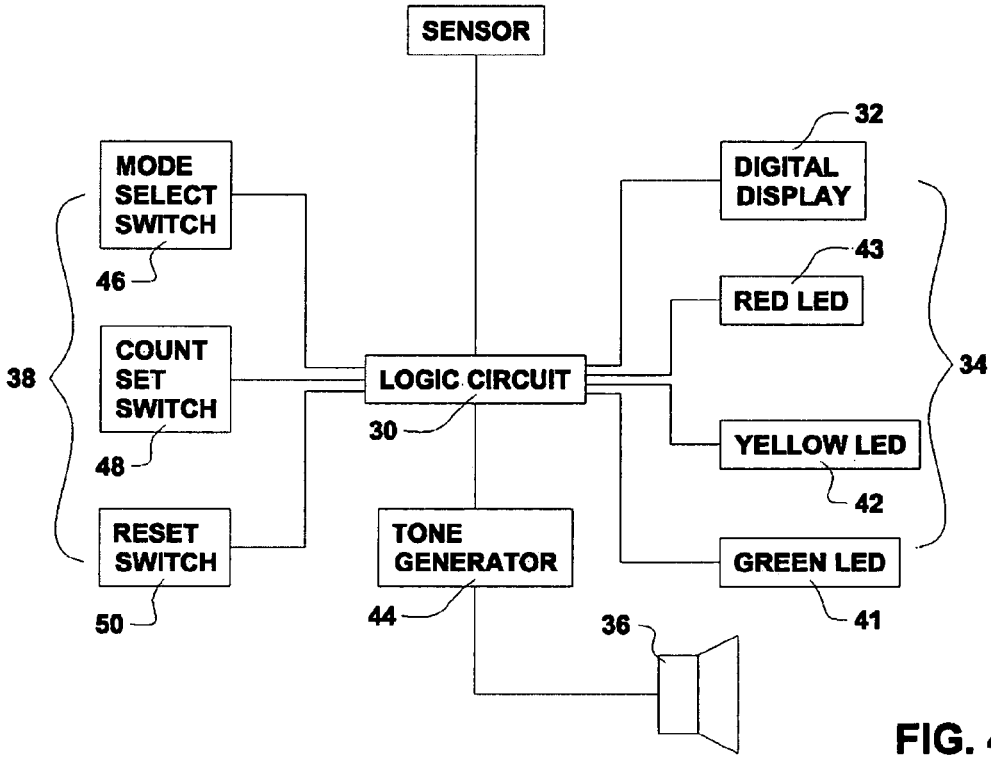
FIG. 4 is a schematic of an exemplary embodiment of the electronics module.

Referring to FIG. 3 in conjunction with FIG. 4, it can be seen that the electronics module 20 has a logic circuit 30, a digital display 32, light indicators 34, a speaker 36 and input controls 38. The logic circuit 30 counts the number of acceleration events that have occurred and compares that number to the predicted failure number. The number of acceleration events that have occurred, or the number of acceleration events that are left to occur are displayed upon the digital display 32.

The light indicators 34, in the shown embodiment, include a green light indicator 41, a yellow light indicator 42 and a red light indicator 43. If the number of acceleration events is less than seventy five percent (75%) of the number predicted to failure, then the green light indicator 41 is lit. If the number of acceleration events exceeds seventy five percent (75%) but is less than ninety five percent (95%) of the predicted failure number, then the yellow indicator light 42 is lit. Lastly, if the number of acceleration events surpasses ninety five percent (95%) of the predicted maximum, then the red indicator light 43 is lit.

The use of the three light indicators 34 can be supplemented or replaced by the use of a tone generator 44. The tone generator 44 is coupled to the speaker 36. The tone generator 44 can produce tones, either periodically, or after each acceleration event, that are indicative of the status of the string. The tone can change pitch, frequency, volume and/or melody as the number of acceleration events approaches the predicted failure number.

The input controls 38 preferably include a mode select switch 46. The mode select switch 46 is used to adjust the direction of count. By using the mode select switch 46, the logic circuit 30 can be caused to either count up to a predicted failure number or count down from a predicted failure number.

A count set switch 48 is also provided. The count set switch 48 enables a person to input the predicted failure number. The failure number is a function of string diameter, string material, string tension and racket head configuration. The predicted failure number may be predetermined by the racket manufacturer and preprogrammed into the logic circuit 30. Alternatively, a person can be able to find the predicted failure number by referencing a precalculated reference chart.

A reset switch 50 is provided that enables the electronics module 20 to restart the count sequence when the string of the tennis racket assembly is replaced.

Returning to FIG. 1, it can be understood that to use the present invention, the following steps are followed. First, a tennis racket assembly 10 is provided that contains the electronics module 20. The tennis racket assembly 10 can be manufactured with the electronics module 20 or the electronics module 20 can be retroactively added to the tennis racket assembly 10.

Second, the predicted failure number for the string 14 used in that tennis racket assembly 10 is programmed into the electronics module 20.

Third, the count sequence is started. Once the count sequence is started, only acceleration events that significantly deform the string 14 are counted. As the number of acceleration events approaches the predicted failure number, some indication is provided.

The indications can be visual and/or audible and enables a person to determine when the string 14 used in the tennis racket assembly 10 is statistically predicted to break. The person using the tennis racket assembly 10 will therefore have the opportunity to change the string before it breaks during a game. As a result, the player will have his/her racket fail less often during play.

It will be understood that the figures described above illustrate only one exemplary embodiment of the present invention. A person skilled in the art can make numerous alterations and modifications to the shown embodiment utilizing functionally equivalent components to those shown and described. For example, the colored light indicators can be replaced by a diminishing bar graph or histogram that is displayed on the digital display. Furthermore, the location and type of input controls can be varied to the needs of the manufacturer. The tone generator and input controls are also optional and the invention can be practiced without these features. All such modifications are intended to be included within the scope of the present invention as defined by the appended claims.

What is claimed is:

1. A racket assembly comprising:

a handle;

a racket head supported by said handle;

a string strung across said racket head forming a string face, wherein said string is statistically likely to fail after said string face is impacted a precalculated number of times;

at least one sensor for detecting when said racket head experiences a change in acceleration that exceeds a predetermined threshold level;

a logic circuit that creates a count corresponding to the number of times said at least one sensor detects a change in acceleration in excess of said predetermined threshold level; and an indicator that provides a plurality of visual indications that change as said count approaches said precalculated number.

2. The assembly according to claim 1, wherein said perceivable indication is a visual indication.

3. The assembly according to claim 1, further including a display for displaying said count.

4. The assembly according to claim 1, further including input controls for inputting said precalculated number.

5. The assembly according to claim 1, wherein said plurality of visual indicators includes lights of different colors.

6. The assembly according to claim 1, wherein said indicator provides an audible indication.

7. The assembly according to claim 1, wherein said at least one sensor and said indicator are contained in an electronic subassembly.

8. The assembly according to claim 7, wherein said electronic subassembly is selectively detachable from said racket assembly.

9. The assembly according to claim 8, further including a neck region between said handle and said racket head, wherein said electronic subassembly is disposed in said neck region.

10. The assembly according to claim 1, further including a reset control for selectively resetting said count to zero.

11. A method of indicating when the string of a racket is statistically likely to break, said method comprising the steps of:

providing a racket having a string face made from a string, wherein said string is statistically likely to fail after said string face is impacted a precalculated number of times;

providing at least one sensor that detects when the string face has incurred an impact;

providing a logic circuit that creates a count of the number of impacts incurred by the string face and compares that number to the precalculated number; and providing an indication when said count approaches said precalculated number.

12. The method according to claim 11, wherein said indication is an audible indication.

13. The method according to claim 11, further including the step of displaying said count on a display.

14. The method according to claim 11, further including the step of inputting said precalculated number.

15. The method according to claim 11, wherein said step of providing an indication includes providing a plurality of visual indications that change as said count approaches said precalculated number.

16. The method according to claim 15, wherein said plurality of visual indications includes lights of different colors.

17. A racket assembly comprising:

a handle;

a racket head supported by said handle;

a string strung across said racket head forming a string face, wherein said string is statistically likely to fail after said string face is impacted a precalculated number of times;

at least one sensor for detecting when said racket head experiences a change in acceleration that exceeds a predetermined threshold level;

a logic circuit that creates a count corresponding to the number of times said at least one sensor detects a change in acceleration in excess of said predetermined threshold level;

an input control for inputting said precalculated number to said logic circuit; and an indicator for providing a perceivable indication when said count approaches said precalculated number.

* * * * *